US005156522A

United States Patent [19]

Tessier

[11] Patent Number: 5,156,522

[45] Date of Patent: Oct. 20, 1992

[54] DEFLECTOR MEANS FOR CENTRIFUGAL PUMPS

[75] Inventor: Lynn P. Tessier, Cochrane, Canada

[73] Assignee: Exxon Production Research Company, Houston, Tex.

[21] Appl. No.: 693,751

[22] Filed: Apr. 30, 1991

[30] Foreign Application Priority Data

Apr. 30, 1990 [CA] Canada ..... 2015777

[51] Int. Cl.[5] ..... F01D 5/04

[52] U.S. Cl. ..... 415/58.2; 415/58.4; 415/170.1

[58] Field of Search ..... 415/52.1, 58.2, 58.3, 415/58.4, 170.1, 182.1, 208.1

[56] References Cited

U.S. PATENT DOCUMENTS

| | | | |
|---|---|---|---|
| 1,862,523 | 6/1932 | Anderson | 415/58.3 |
| 2,444,100 | 6/1948 | Hill | 415/58.3 |
| 2,766,698 | 10/1956 | Carter | 415/58.3 |
| 2,865,297 | 12/1958 | Cliborn . | |
| 3,011,693 | 12/1961 | Downs et al. | 415/58.3 |
| 3,079,866 | 3/1963 | Walker . | |
| 3,139,831 | 7/1964 | Pollak . | |
| 3,221,661 | 12/1965 | Swearingen | 415/58.3 |
| 3,504,986 | 4/1970 | Jackson . | |
| 3,723,019 | 3/1973 | Berman . | |
| 4,208,166 | 6/1980 | Schroeder et al. . | |
| 4,269,564 | 5/1981 | Naffziger | 415/58.3 |
| 4,371,310 | 2/1983 | Henry, IV et al. . | |
| 4,492,516 | 1/1985 | McCoy, Jr. . | |
| 4,527,948 | 7/1985 | Addie . | |
| 4,637,778 | 1/1987 | Pollari . | |
| 4,708,584 | 11/1987 | Meng . | |
| 4,746,269 | 5/1988 | Raab | 415/170.1 |
| 4,834,611 | 5/1989 | Meng . | |

FOREIGN PATENT DOCUMENTS

| | | |
|---|---|---|
| 1398148 | 6/1975 | United Kingdom . |
| 2051239A | 1/1981 | United Kingdom . |

OTHER PUBLICATIONS

"Recirculation in Centrifugal Pumps", W. H. Fraser, World Pumps, 1982-188, pp. 228-235.

*Centrifugal and Axial Flow Pumps: Theory, Design, and Application*, A. J. Stepanoff, John Wiley and Sons, Inc., 2nd ed., 1957, pp. 182-203 (Ch. 10).

*Primary Examiner*—Edward K. Look
*Assistant Examiner*—Christopher M. Verdier
*Attorney, Agent, or Firm*—Keith A. Bell

[57] ABSTRACT

Improvements in centrifugal pumps are disclosed which minimize flow recirculation effects induced by wear ring leakage flow. The improvements may be used individually or in combination and comprise deflector means attached to the impeller, diverter means attached to the casing or impeller or wear ring inducer means.

2 Claims, 6 Drawing Sheets

DEFLECTOR MEANS FOR CENTRIFUGAL PUMPS

BACKGROUND OF THE INVENTION

1. Field of the Invention

This invention relates to improvements in centrifugal pump performance and reliability. More particularly, but not by way of limitation, the invention pertains to apparatus for minimizing flow recirculation effects induced by wear ring leakage flow.

2. Description of the Prior Art

A wide variety of fluids (including water, hydrocarbons, slurries, air, natural gas, and other liquid and gaseous fluids) are pumped using centrifugal pumps. Centrifugal pumps generally provide steady flow at uniform pressures without the pressure surges characteristically found with reciprocating pumps. Consequently, they are applied in a diversity of processes requiring uniform pressures. Examples of typical processes requiring centrifugal pumps include steam power plants, water supply plants, oil refineries, chemical plants, steel mills, food processing factories, mining operations, dredging operations, and hydraulic power systems.

A typical prior art centrifugal pump is illustrated in FIGS. 1 and 2. The pump 10 has an impeller 22 having a plurality of impeller vanes 24. The impeller 22 is mounted on a shaft 28. The impeller 22 and the shaft 28 are rotatably mounted in a housing or casing 12. A motor or other power source (not shown) is used to rotate the shaft 28.

Fluid is pumped through a centrifugal pump by rotating the impeller 22 and the shaft 28. This rotation creates a suction at the inlet 13 of the pump (also known as the "eye side" of the pump), causing the fluid to travel into the pump. The impeller 22 then forces the fluid radially outwardly through the impeller 22, past the discharge tips 25 of the impeller vanes 24, and into the discharge annulus 17 leading to the discharge port 16. As illustrated in FIGS. 1 and 2, discharge annulus 17 has a volute shape; however, other centrifugal pumps utilize a discharge annulus having a uniform cross section. The discharge port 16 is connected to, or in fluid communication with, an output pipe or conduit (not shown) through which the fluid is pumped. The inlet 13 of the pump is typically connected to a pipe or conduit (not shown) through which fluid flows toward the centrifugal pump.

The fluid passes through the pump predominantly in a flow pattern hereinafter identified as the "primary fluid flow." As illustrated in FIG. 2, the primary fluid flow P through the pump 10 passes from the inlet 13 towards the impeller 22 while remaining substantially parallel to the longitudinal centerline of pump shaft 28. The primary fluid flow subsequently undergoes an approximately 90 degree change of direction in passing through the impeller 22 with the fluid propelled radially outwardly towards the discharge annulus 17. The fluid then flows through the discharge annulus to the discharge port and out of the pump.

A typical prior art centrifugal pump utilizes at least one controlled leakage joint between the rotating impeller and the stationary housing to reduce wear due to friction. Typically, most pumps utilize both an eye side controlled leakage joint 30 and a hub side controlled leakage joint 32. A controlled leakage joint permits a small amount of the fluid to pass or "leak" between its moving and stationary surfaces so as to reduce friction.

Leakage flow through the hub side controlled leakage joint 32 results in a portion of the fluid getting into the cavity 33 (see FIG. 3) between the hub side of impeller 22 and housing 12. This fluid must be permitted to flow back to the eye side of the impeller 22 in order to hydraulically balance the impeller 22. Thus, impellers typically include one or more balance holes 34 which permit this flow. At normal pump operating speeds, the flow through the balance holes does not create any significant problems. However, as illustrated in FIG. 3, at low pump flow rates the balance hole leakage flow causes turbulence, commonly referred to as leakage flow recirculation, in the pump inlet 13 and impeller eye 18 which substantially reduces the overall efficiency of the pump.

Leakage flow also occurs through the eye side controlled leakage joint 30. This leakage flow results from the pressure differential between the fluid in the discharge annulus 17 and the fluid in the pump inlet 13. The higher pressure at the discharge annulus 17 relative to the pressure at the pump inlet 13 generates a leakage flow towards the pump inlet 13. The eye side controlled leakage joint 30 serves to control this eye side leakage flow. However, as illustrated in FIG. 3, at low pump flow rates the eye side controlled leakage flow also causes turbulence (leakage flow recirculation) in the pump inlet 13 and impeller eye 18 which additionally contributes to reducing pump efficiency. Additional information on the effects of leakage flow on pump efficiency may be found in *Centrifugal and Axial Flow pumps*, Stepanoff, A. J., 2nd edition, John Wiley & Sons, Ch. 10.

At sufficiently low pump flow rates, significant adverse consequences may result from leakage flow recirculation. Problems arising from leakage flow recirculation include broken shafts, short seal life, failed bearings, high vibration, noisy operation, flow instability (i.e., surging), and cavitation damage on the pressure side of the impeller vanes.

In addition to leakage flow recirculation, two other types of recirculation, suction recirculation and discharge recirculation, can adversely affect a centrifugal pump's performance. These types of recirculation may induce problems similar to those caused by leakage flow recirculation. Suction recirculation is a flow reversal where fluid flows in the center of the inlet 13 toward the pump, while fluid along the periphery of inlet 13 reverses and flows away from the pump. Discharge recirculation is reversal of flow at the impeller vane discharge tips 25. An extended discussion of suction and discharge recirculation is presented in "Recirculation in Centrifugal Pumps," Fraser, W. H., Winter Annual Meeting of ASME, Nov. 15–20, 1981.

The prior art has focused on arresting suction and discharge recirculation. For example, Cliborn's U.S. Pat. No. 2,865,297 illustrates a device which reinjects fluid from the pump discharge to the impeller inlet for preventing suction and discharge recirculation. McCoy's U.S. Pat. No. 4,492,516 improves on Cliborn's teachings with an apparatus and method used to control the angle and direction at which the fluid is reinjected. Both Cliborn and McCoy limit the scope of their respective inventions to resolving the suction and discharge recirculation problems.

Another mechanism for arresting suction recirculation is an inducer (i.e. a screw like device attached to the front of the impeller) which serves to enhance fluid flow into the impeller. Jackson's U.S. Pat. No. 3,504,986 and Berman's U.S. Pat. No. 3,723,019 disclose the use of an inducer to combat suction recirculation. An inducer, however, counteracts recirculation effects under a principle similar to that applied in Cliborn's and McCoy's discharge fluid reinjection devices, namely, by increased pump flow rate to the impeller.

Another method commonly used to minimize recirculation effects is to operate the pump at an artificially high pump flow rate. Particularly where low process stream flow rates are required, the high pump flow rate needed to minimize recirculation effects is achieved by a recycle line (not shown) communicating between the discharge port 16 and pump inlet 13. The recycle, thereby, permits release of only that portion of the pumped fluid required for maintaining the desired process flow rate, despite the high pump flow rate.

In all the aforementioned cases, the recirculation effect is minimized by increasing the pump flow rate through the impeller with reinjection or inducer means or recycling flow from discharge to inlet. However, these means are inefficient by virtue of the additional energy and equipment required. Accordingly, a need exists for a means of correcting leakage flow recirculation effects at low pump flow rates without the necessity for using additional energy and equipment. The present invention provides apparatus for improving a centrifugal pump's inherent resistance to producing leakage flow recirculation.

SUMMARY OF THE INVENTION

This invention relates to three separate devices, which may be used either individually or in combination, to direct a centrifugal pump's controlled leakage flow in the direction of its primary flow thereby reducing or eliminating leakage flow recirculation effects, even at low pump flow rates. The first device is a deflector means which may be attached to the impeller for redirecting balance hole leakage flow in the direction of the primary flow. The second device is a diverter means which may be attached to the casing or impeller for directing eye side leakage flow into the primary flow path. The third device is a wear ring inducer means for simultaneously raising impeller inlet flow pressure while directing eye side leakage flow along the primary flow path.

In a preferred embodiment the deflector means for redirecting impeller balance hole leakage flow in attached to the pump's center shaft on the impeller's eye side and secured by an impeller retaining means. The deflector means may comprise a shroud which extends from the center shaft and remains at some fixed clearance over the impeller balance hole. Alternatively, the deflector means may be attached directly to the impeller hub or the impeller itself may incorporate an impeller balance hole design which conforms balance hole leakage flow with the primary flow path.

A preferred embodiment of the diverter means for redirecting eye side leakage flow is attached to the pump's casing and extends to at least cover the clearance between the pump casing and the front edge of the impeller. Alternatively, the diverter means may be attached to the impeller by means apparent to those skilled in the art or embodied into the casing design.

The inducer means, which uses the eye side leakage flow to boost the pressure of the inlet flow at the eye side, is incorporated by design into the eye side controlled leakage joint. In a preferred embodiment, the casing has a cavity or recess for receiving the front edge of the impeller. The resulting leakage joint design develops a leakage flow velocity which is greater than the fluid velocity at the pump inlet, and the direction of the leakage flow is substantially parallel to that of the primary fluid flow. The frictional forces between the leakage and inlet fluid flow allow the higher velocity leakage flow to entrain lower velocity inlet flow, thereby raising the inlet fluid pressure at the eye of the impeller and hence reducing the apparent Net Positive Suction Head Required (NPSHR) at the pump inlet. (NPSHR is the minimum fluid pressure required at the pump inlet to prevent flashing of the pumped fluid caused by localized low pressure points in the pump cavity.) The inducer means prevents separation of the primary fluid flow from the impeller's outer shroud, thereby minimizing recirculation effects caused by such a separation.

DESCRIPTION OF THE DRAWINGS

The actual operation of the proposed centrifugal pump modifications will be better understood by referring to the following detailed description and the attached drawings in which.

DESCRIPTION OF THE PREFERRED EMBODIMENT

Figure 1:
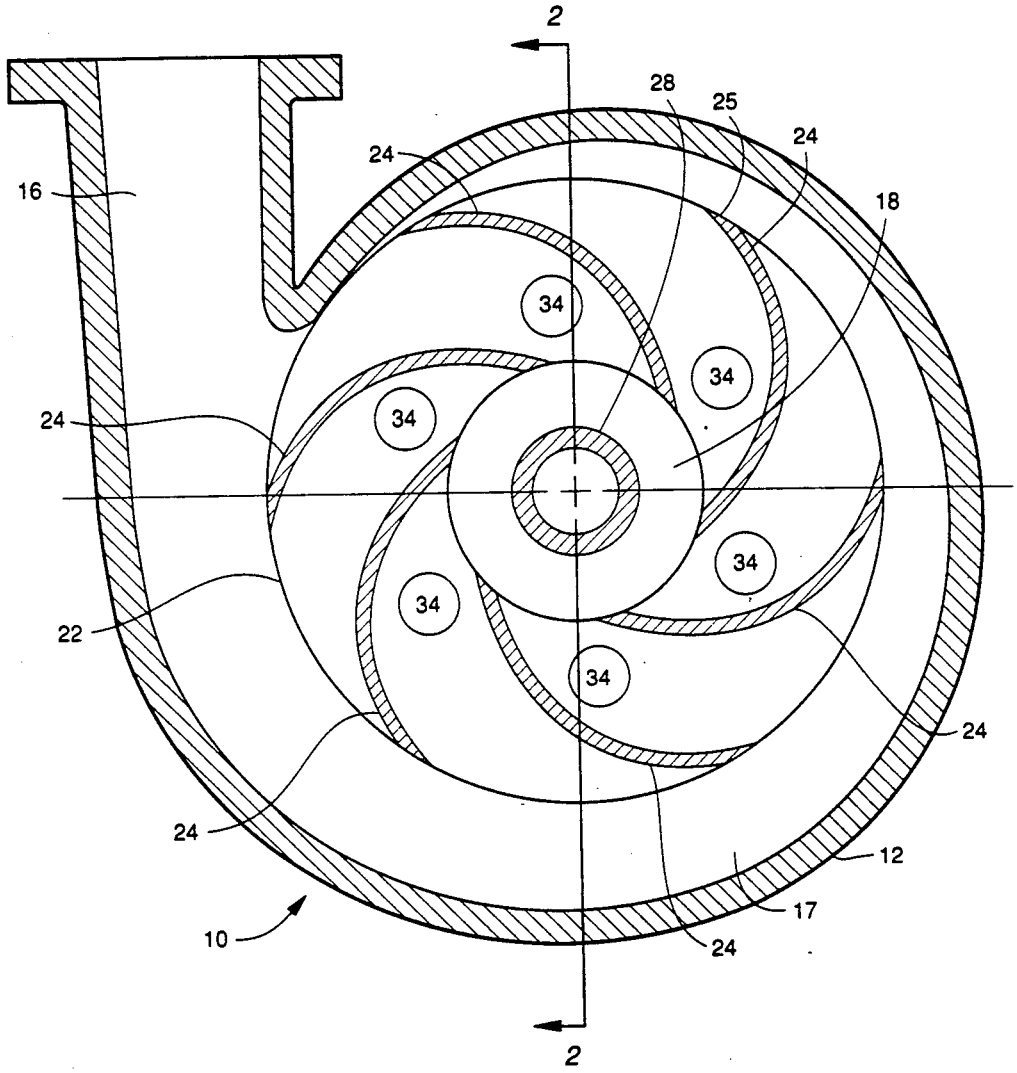
FIG.1 PRIOR ART
FIG. 1 is a cross-sectional view of a typical volute type centrifugal pump of the prior art taken along line 1—1 of FIG. 2.
Figure 2:
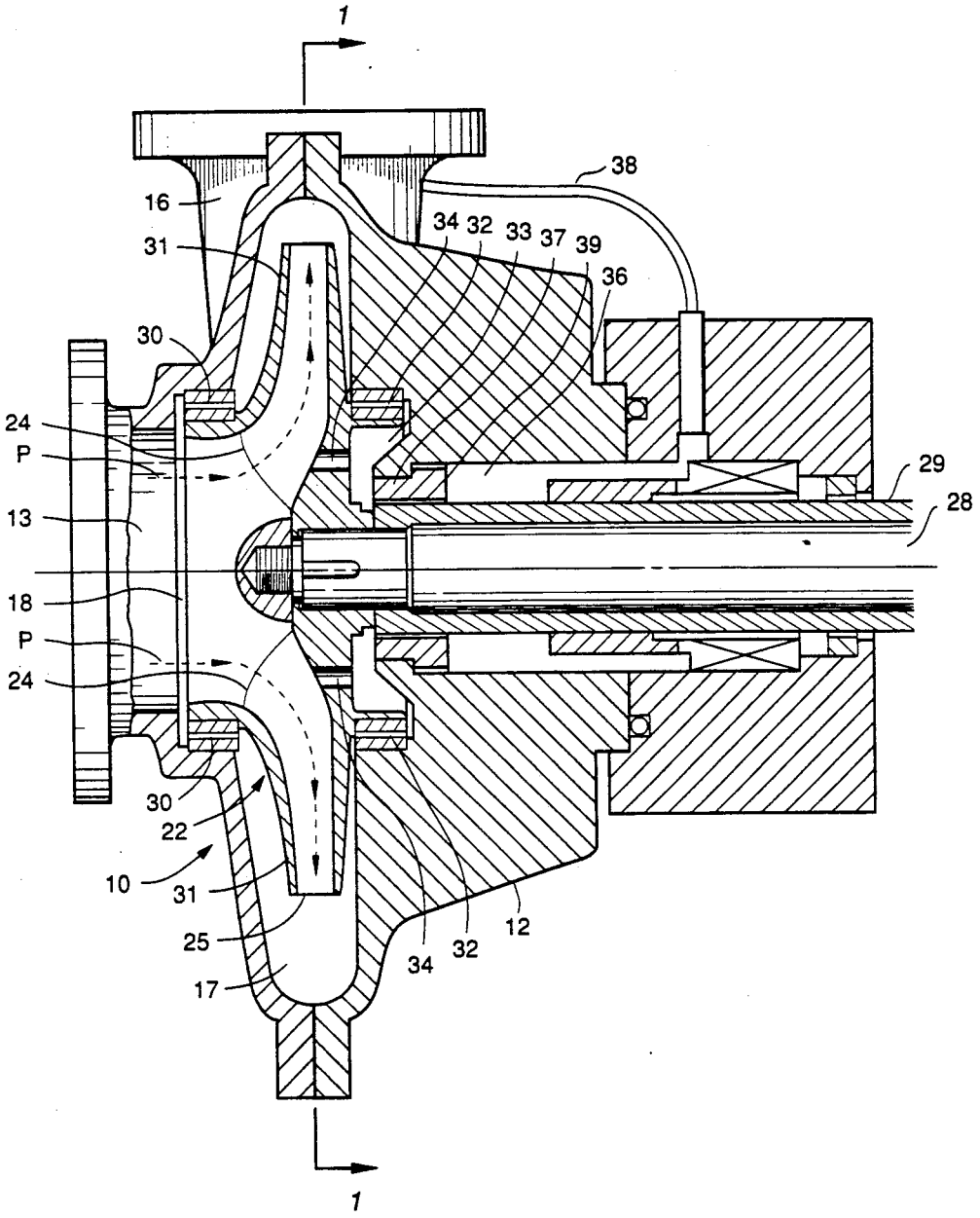
FIG. 2 PRIOR ART
FIG. 2 is a cross-sectional view of a typical volute type centrifugal pump of the prior art taken along line 2—2 of FIG. 1 and illustrates the direction of primary flow of fluid through the pump.

Referring to FIGS. 1 and 2 of the drawings, the primary flow of fluid (indicated by dashed line P) enters the pump 10 through pump inlet 13. At this point the fluid is propelled toward the discharge annulus 17 where the fluid is under greater pressure than at the pump inlet 13. This pressure differential is accomplished by rotating impeller 22 comprised of a plurality of vanes 24 symmetrically oriented about a center shaft 28. The impeller 22 discharges the fluid at a high velocity. The pump casing 12 functions to reduce this velocity and convert kinetic energy into pressure energy, either by means of a divergent volute or a set of diffusion values (not shown).

Figure 3:
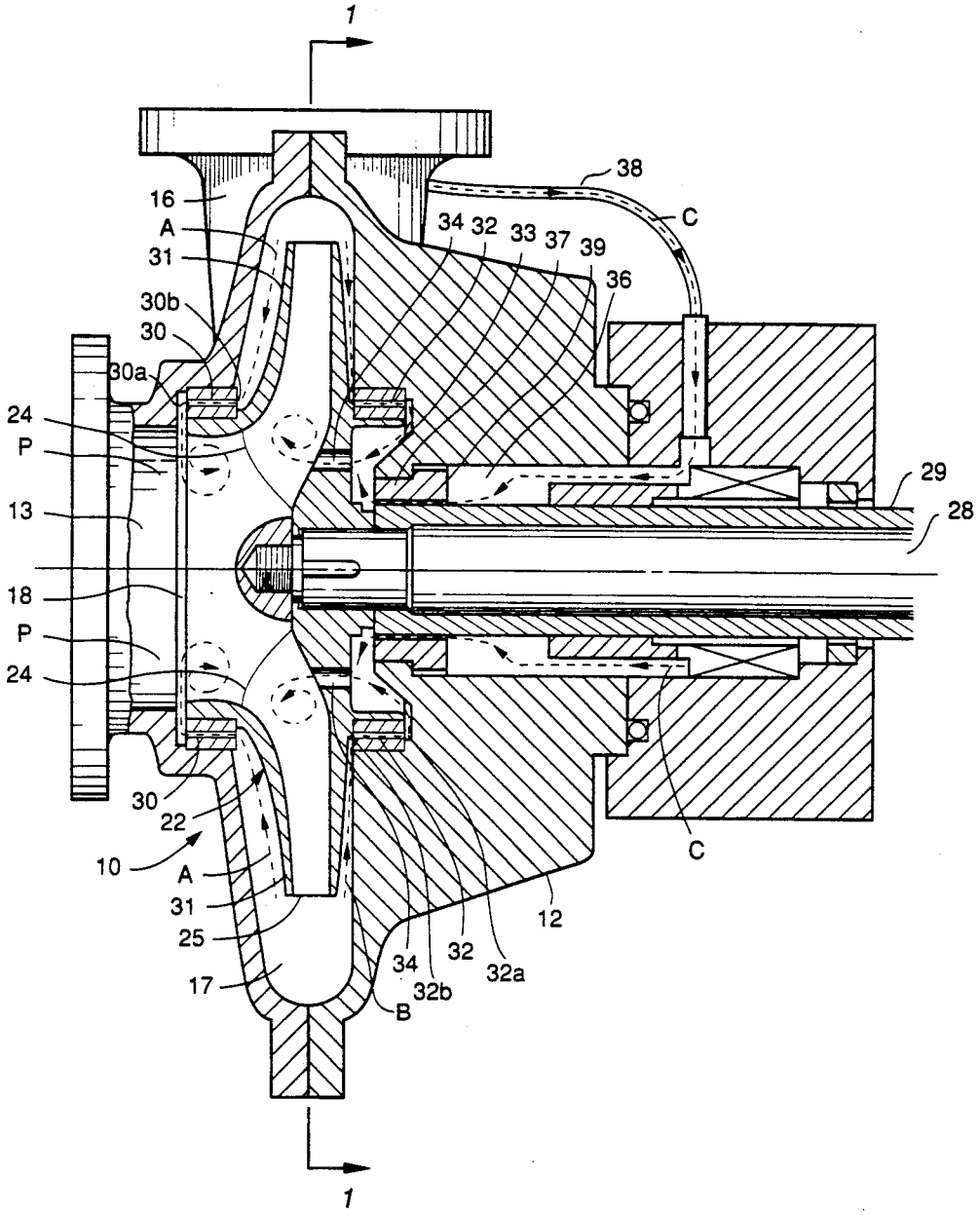
FIG. 3 PRIOR ART
FIG. 3 is a cross-sectional view illustrating the sources of impeller balance hole and eye side controlled leakage flow with the resulting recirculation effects.

FIG. 3 depicts how the higher pressure in the pump's discharge flow creates a controlled leakage flow back towards the inlet 13 where fluid pressure is lower. Generally, this leakage flow passes back towards the eye side of impeller 22 by three distinct pathways (indicated by dashed lines A, B, and C). One pathway A is by way of the eye side controlled leakage joint 30. The higher pressure fluid enters the eye side leakage joint at its inner end 30*b*, flows through the leakage joint towards its outer end 30*a* and exits into the pump inlet port 13.

A second pathway B, frequently found in centrifugal pumps, passes through hub side controlled leakage joint 32 and an impeller balance hole 34. The higher pressure fluid enters the hub side controlled leakage joint 32 at its inner end 32*b*, flows through the leakage joint towards its outer end 32*a* into hub side cavity 33, and exits by way of the impeller balance hole 34.

The third pathway C, found in many centrifugal pumps, travels from the discharge port 16 to the stuffing box 36 via tubing 38. Fluid from the stuffing box 36 exits through a clearance 37 between the shaft sleeve 29 and bushing 39 into hub side cavity 33 and subsequently enters the impeller eye 18 via an impeller balance hole 34.

At low pump flow rates, each of these leakage flows can result in damaging flow turbulence (i.e., leakage flow recirculation) in the pump inlet 13 and impeller eye 18. The present invention comprises three devices which individually or collectively lower the pump flow rate at which damaging flow turbulence due to leakage flow recirculation is observed.

Figure 4:
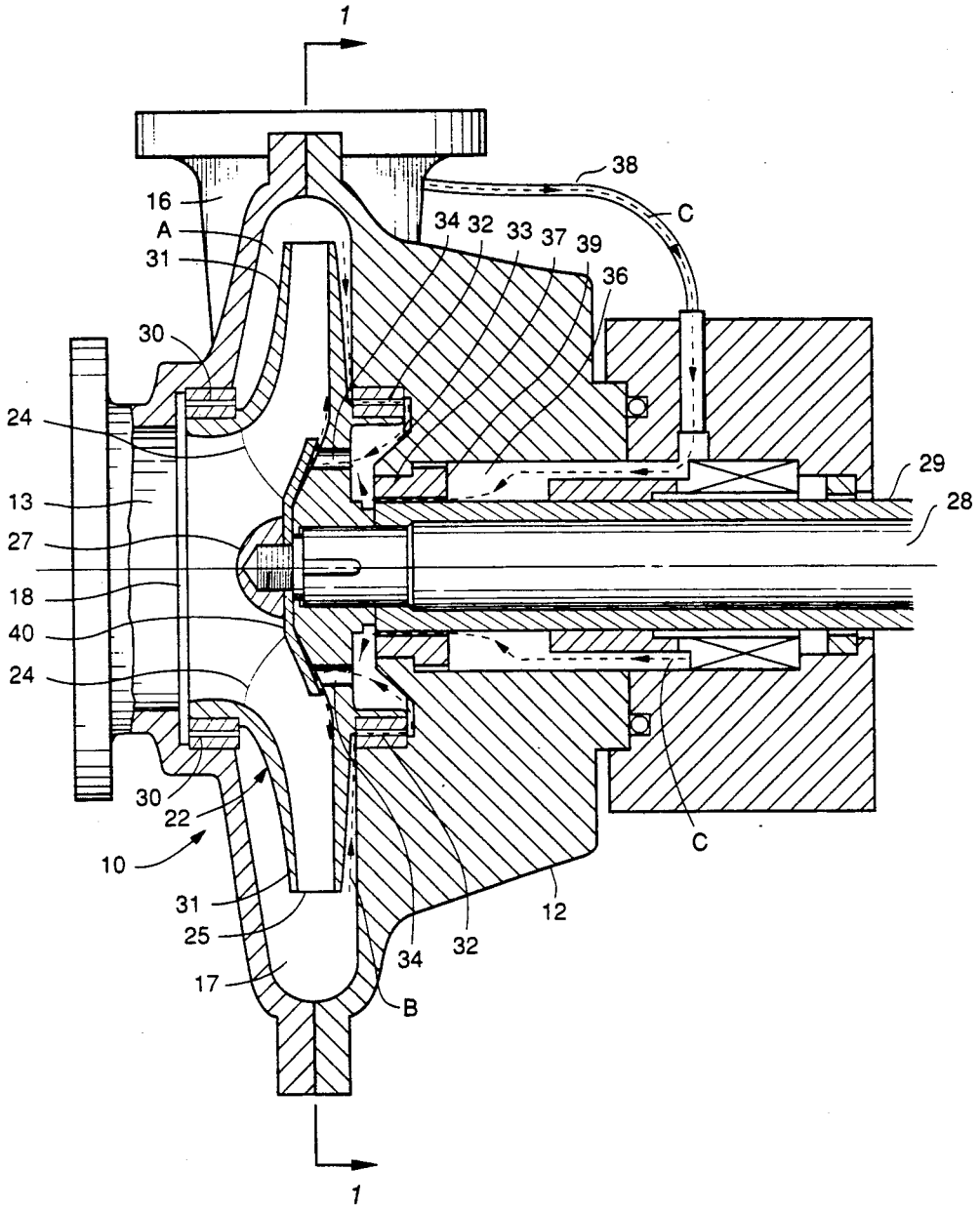
FIG. 4 is a cross sectional view illustrating a deflector means for redirecting impeller balance hole leakage flow along primary fluid flow pathway.

FIG. 4 illustrates a preferred embodiment of a deflector means for redirecting the impeller balance hole leakage flow B and C. The deflector means is a cup-shaped shroud 40 attached to the eye side of the impeller 22 by a retaining nut 27 on the center shaft 28. The shroud 40 extends to at least cover the impeller balance hole 34 while remaining at some fixed clearance over the balance hole 34. As leakage flow B and C exit from the balance hole 34 it impinges the shroud 40. The leakage flow B and C are subsequently directed radially outwardly toward the discharge annulus 17. Such a diversion of the balance hole leakage flow reduces the turbulence in the pump inlet 13 and impeller eye 18, thereby reducing impeller balance hole recirculation effects.

Figure 5:
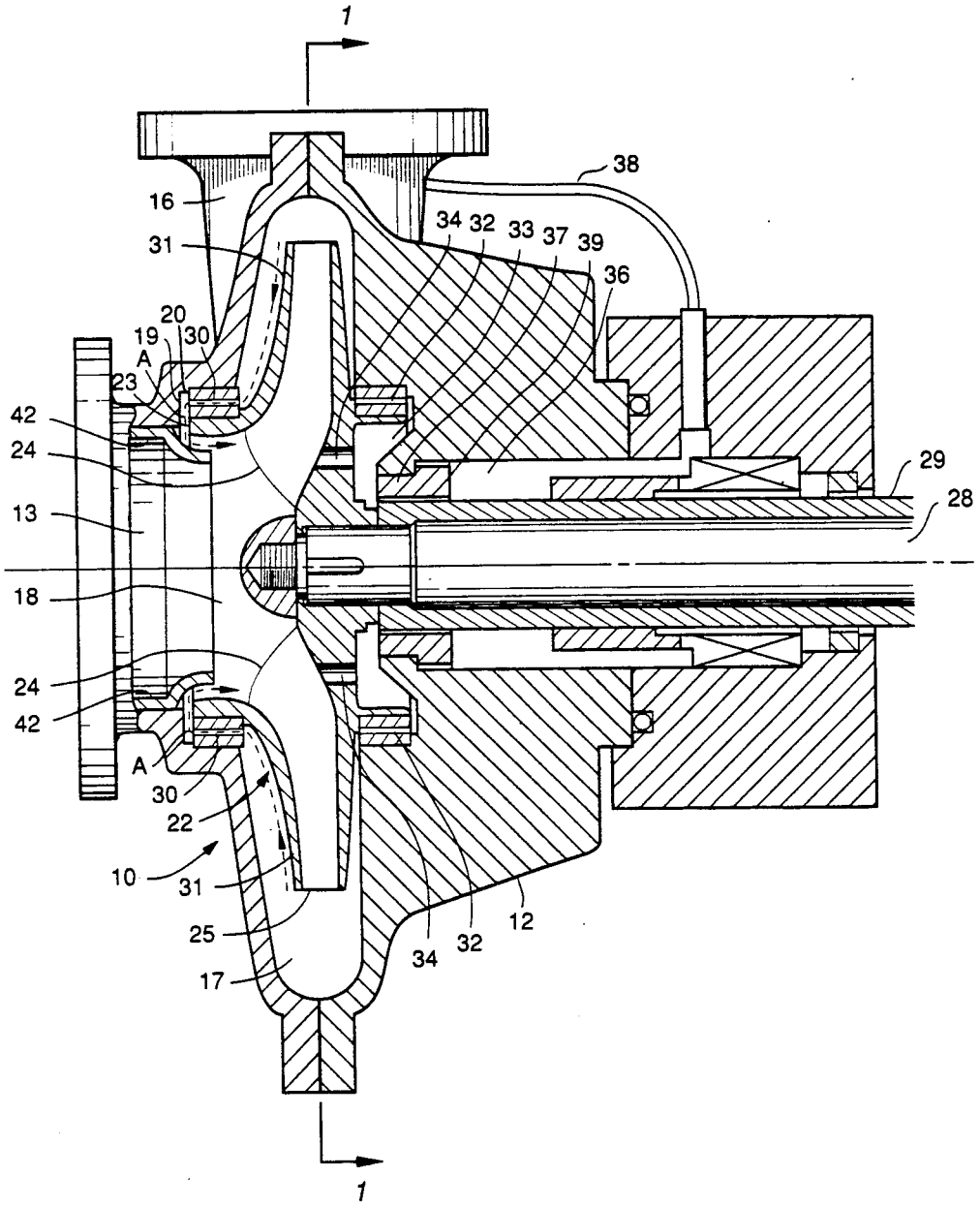
FIG. 5 is a cross sectional view illustrating a diverter means for redirecting eye side controlled leakage flow along the primary fluid flow pathway.

As seen in FIG. 5, a preferred embodiment of a diverter means for redirecting the eye side controlled leakage flow A is an elongated shroud 42 rigidly attached to the casing. Generally, the eye side shroud 42 will extend at least over the clearance 20 between the casing's eye side wall 19 and the impeller's front edge 23, which receives the eye side leakage flow A exiting the leakage joint's outer end 30*a*. The deflector is shaped and oriented in a manner which will conform the eye side leakage flow with the pump's primary flow.

Figure 6:
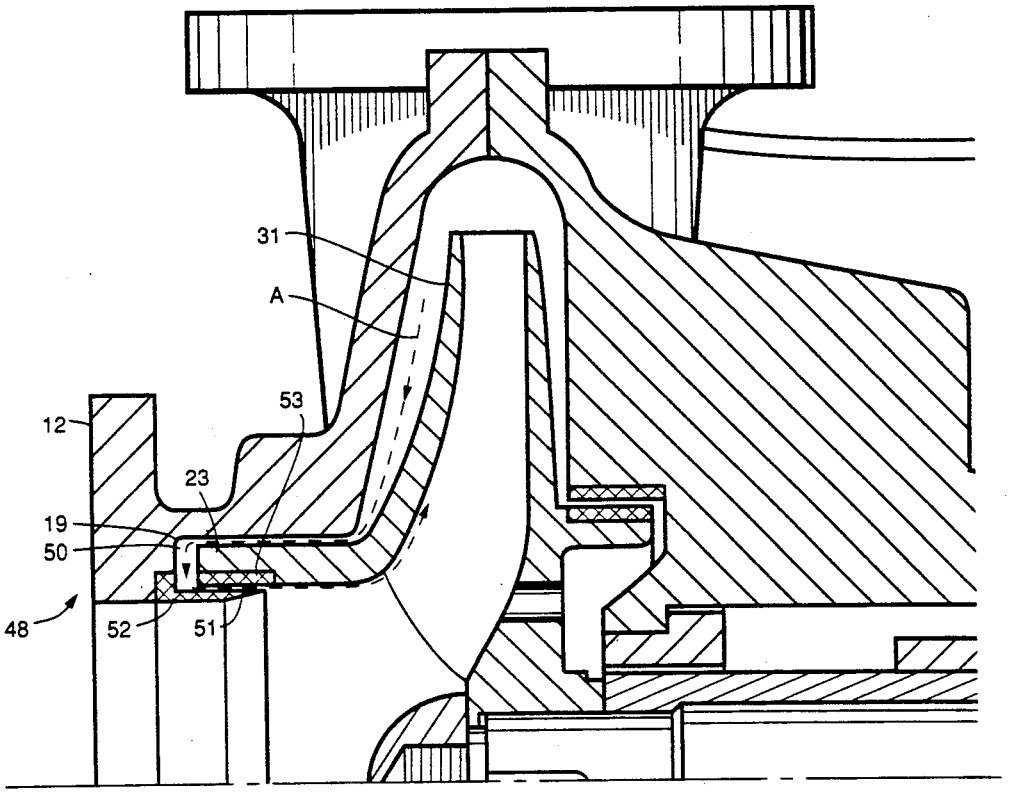
FIG. 6 is a cross sectional view illustrating a wear ring inducer means for utilizing the leakage flow to boost the inlet fluid pressure and conforming the leakage flow to the primary flow direction.

FIG. 6 illustrates a wear ring inducer means 48, for controlling the direction of the eye side leakage flow and decreasing the NPSHR at the eye of the impeller. The leakage flow exits the clearance 51 between a wear ring 53 on the impeller's eye side inner diameter and a casing wear ring 52 extending from the eye side wall 19 and placed adjacent to the impeller's eye side inner diameter. By contrast, the wear rings for a conventional eye side leakage joint 30 (see FIG. 2) are typically located on the impeller's eye side outer diameter. Consequently, when the leakage flow exits a conventional joint's outer end 30*a* (see FIG. 3), its direction and velocity (resulting from the pressure differential between the discharge port 16 and the pump inlet 13) is substantially perpendicular to the primary fluid flow at pump inlet 13 (the "impeller inlet flow") and its kinetic energy is randomly dissipated in the pump inlet 13.

With the wear ring inducer means 48, the direction and velocity of the leakage flow is parallel to the impeller inlet flow. Due to the high pressure differential across the wear ring inducer, the leakage flow velocity will be much greater than the impeller inlet flow. Since the two flows are in the same direction, the kinetic energy inherent in the high velocity leakage flow stream will be transferred to the impeller inlet flow. This transfer of kinetic energy will result in a slight increase in pressure of the impeller inlet flow at the impeller eye 18 and hence, a reduction in the apparent NPSHR at the pump inlet 13. Additionally, the wear ring inducer means 48 conforms the leakage flow with the primary flow along the impeller's outer shroud 31, and thereby prevents separation of the primary flow from the impeller's outer shroud 31. Both of these wear ring inducer effects act to minimize pump cavity turbulence which typically occurs at low pump flow rates.

A preferred apparatus and mode of practicing the invention have been described. It is to be understood that the foregoing is illustrative only and that other means and techniques can be employed without departing from the true scope of the invention defined in the following claims.

What is claimed is:

1. In a centrifugal pump having (a) a stationary pump casing defining an internal pump cavity, said pump casing having an eye side, a hub side, and a central axis extending therebetween, (b) an inlet port located in said eye side of said pump casing substantially coincident with said central axis, (c) a discharge port located in said pump casing, (d) a rotatable impeller located in said internal pump cavity and adapted to rotate about said central axis, said rotatable impeller having an eye side adjacent said eye side of said pump casing, a hub side adjacent said hub side of said pump casing, and one or more impeller balance holes extending through said rotatable impeller, (e) means for rotating said rotatable impeller, and (f) at least one controlled leakage joint between said rotatable impeller and said hub side of said stationary pump casing thereby defining a hub side cavity between said hub side of said rotatable impeller and said hub side of said pump casing, whereby fluid enters said internal cavity through said inlet port, is forced radially outwardly by said rotatable impeller, and exits said internal cavity through said discharge port, a portion of said fluid passing through said controlled leakage joint into said hub side cavity and thence through said one or more impeller balance holes to said eye side of said rotatable impeller so as to hydraulically balance said rotatable impeller, wherein the improvement comprises:

deflector means attached to said rotatable impeller for directing said fluid passing through said one or more impeller balance holes in a radially outwardly direction so as to reduce turbulence in said internal pump cavity.

2. The centrifugal pump improvements described in claim 1, wherein said rotatable impeller is attached to a rotatable shaft by an impeller retaining means and wherein said deflector means comprises a cup-shaped shroud attached to said impeller by said impeller retaining means, said cup-shaped shroud extending radially outwardly at least to said one or more impeller balance holes.

* * * * *